US005523528A

United States Patent [19]

Bese et al.

[11] Patent Number: 5,523,528

[45] Date of Patent: Jun. 4, 1996

[54] INTERCONNECTION CABLE FOR LOW FREQUENCY SIGNAL TRANSMISSION

[76] Inventors: Attila Bese, Somfa köz 2., H-1107 Budapest; Sándor Füzesi, Dagály u. 2o., H-1138 Budapest, Hungary

[21] Appl. No.: 170,051

[22] Filed: Dec. 20, 1993

Related U.S. Application Data

[63] Continuation of PCT/HU92/00026, Jun. 26, 1992, published as WO93/00687, Jan. 7, 1993.

[30] Foreign Application Priority Data

Jun. 26, 1991 [HU] Hungary ..... 21 26/91

[51] Int. Cl.[6] ..... H01B 7/34

[52] U.S. Cl. ..... 174/36; 174/109; 174/113 C; 174/115; 174/131 A

[58] Field of Search ..... 174/36, 115, 113 C, 174/131 A, 109

[56] References Cited

U.S. PATENT DOCUMENTS

| | | | |
|---|---|---|---|
| 2,344,635 | 3/1944 | Priestley | 174/36 |
| 3,484,532 | 12/1969 | Anderson | 174/36 |
| 3,660,592 | 5/1972 | Anderson | 174/36 |
| 3,815,054 | 6/1974 | McClure et al. | 174/115 |
| 5,216,202 | 6/1993 | Yoshida et al. | 174/36 |
| 5,367,123 | 11/1994 | Plummer, III et al. | 174/36 |

*Primary Examiner*—Morris H. Nimmo
*Attorney, Agent, or Firm*—Schweitzer Cornman & Gross

[57] ABSTRACT

Interconnection cable for transmission of low frequency signals, preferably of audio frequency signals, includes a core (1) ensuring mechanical strength of the cable and surrounded by at least four insulated conductors (2) forming first and second signal path of the cable in equal number. The conductors (2) are covered by an insulation layer (3) of foamed non-polar plastic. A shielding conductor (4) is made of a fabric layer with a density of 55 to 95%, woven of copper wire having a diameter in order of magnitude of several tenth millimeters. An outer shell (5) made of solid plastic covers the assembly of the core (1)/conductors (2)/ shielding conductor (4).

8 Claims, 2 Drawing Sheets

INTERCONNECTION CABLE FOR LOW FREQUENCY SIGNAL TRANSMISSION

This application is a continuation of PCT/HU92/00026, filed Jun. 26, 1992, published as WO93/00687, Jan. 7, 1993.

BACKGROUND OF THE INVENTION

The present invention is generally related to interconnection cables for signal transmission and more particularly to an interconnection cable transmitting low frequency signals, preferably audio frequency signals; having insulated conductors, a woven shielding conductor of meshed wires surrounding said insulated conductors and an outer shell.

The proposed interconnection cable may be advantageously utilised in any connection between signal sources and amplifier units in high-fidelity audio systems.

In the field of high-fidelity audio systems there is a great effort to make improvements in or relating to auxiliary equipment or accessories along with the development of audio signal sources and signal processing equipment. This effort covers improvements in signal conductive structural elements of various kinds, e.g. connectors, cables, device supports or floor stands. Usually, the aim set is to ensure an audio system of total linear signal transmission and absolutely neutral operation.

Considering the above special cables for the interconnection of a power amplifier and a speaker system have been developed. Main characteristic of these cables is a strongly over dimensioned cross-section with reference to the transmitted electrical power. The conductors of this cable are formed of copper fabric woven of ultra-high number of monocrystal, low cross-section wire. The problem of this solution is that said monocrystal wires get broken during the production, have too many interconnecting locations and are non-homogeneous. A further drawback of these cables produced with a labour intensive technology is their high prices being equal to prices of professional audio equipment, resulting in a relative low popularity and use.

The tendency mentioned above has appeared in cables for interconnection of signal sources and signal processing units that the conductors of a cable are made of more and more thinner wires of high increased number and the conductors woven of said wires and having a cross-section suitable for heavy-current engineering are twisted together either in monaural or in stereo construction. The inner conductors insulated from each other are shielded by a shielding layer made of copper fabric woven of high-purity copper wires or silver plated copper wires. The shielding layer is surrounded by an outer shell serving for the mechanical strength of the cable. This technical solution representing the most sophisticated audio cables currently available has the drawback that a full linear signal transmission cannot be achieved and high-fidelity sound reproduction could be affected.

OBJECTS OF THE INVENTION

Accordingly, it is an object of the present invention to provide an improved interconnection cable for transmission of low frequency signals, preferably of audio frequency signals, having a full linear signal transmission and absolutely neutral operation. It is also the object of the present invention to provide an improved interconnection cable for transmission of low frequency signals which achieves use of known and reliable technologies.

The invention is due to the recognition that a full linear signal transmission could be achieved with a relative thick conductor made of few components instead of further increase of the number of the wires forming the conductor.

An interconnection cable for transmission of low frequency signals, preferably of audio frequency signals, comprises insulated conductors laid together, a shielding conductor of woven wires covering said insulated conductors and an outer shell. According to the invention a core ensuring mechanical strength of the cable is surrounded by at least four insulated conductors forming first and second signal path of the cable in equal number; the conductors are surrounded by a insulation layer of foamed non-polar plastic and the shielding conductor is made of a fabric layer with a density of 55 to 95% woven of copper wire having a diameter in order of magnitude of several tenth millimeters.

The main advantage of the proposed cable lies in full clear and linear signal transmission, supported and established by audio test sessions and instrumental measurements. Microphonic effects are essentially reduced by the foamed plastic insulation layer. In a preferred embodiment of the interconnection cable according to the invention the core of the cable is formed of a solid, untinned, oxygen-free copper wire with a diameter of 0.8 mm. This feature is advantageous because the copper wire forming the core ensures increased mechanical strength for the cable; this wire can be utilised for the transmission of a further signal, e.g. a remote control signal being independent from the transmitted main audio signal.

It is advantageous when the core is surrounded by six insulated conductors, three of them forming the first signal path and three of them forming the second signal path of the cable and having an outer diameter causing a continuous ring around the core abutting each other. Due to this feature a cable with proper electrical (linearity) and mechanical (thickness) parameters can be produced.

In a further preferred embodiment of the interconnection cable according to the invention the insulation layer is formed of foamed polyethylene with an average space factor of 40 to 60% and the shielding conductor is formed as a fabric layer with a density of 75% woven of copper wire having a diameter of 0.2 mm. According to a overwhelming majority of hearers of the tests the best results can be achieved with a cable having the afore-mentioned features.

It is advantageous when the conductors forming the first and second signal path of the cable have insulation layers of different colour to facilitate the montage of the cable.

It is further advantageous when the conductors are wrapped around the core in the cable. Such a cable can be produced with usual technology at low costs which results in good mechanical properties.

In a further preferred embodiment of the interconnection cable according to the invention the conductors are lined parallel with the core in the cable. This construction yields in optimal acoustical properties according to the measurements on the cable.

It is further advantageous when the conductors of the cable are soldered to the first, respectively second pin of a screened cinch plug or coupling connector. Due to the construction of these types of connectors the best transition between the cable and the equipment to be interconnected can be achieved.

The described interconnection cable according to the invention is suitable for connection of two monaural audio equipment. For the transmission of stereo signals two cables of same type should be utilised. The final interconnection cable is quite rigid but can be deformed without any damage.

No trouble due the rigidity of the cable has been observed in the plurality of the applications.

DESCRIPTION OF THE PREFERRED EMBODIMENT

Figure 1:
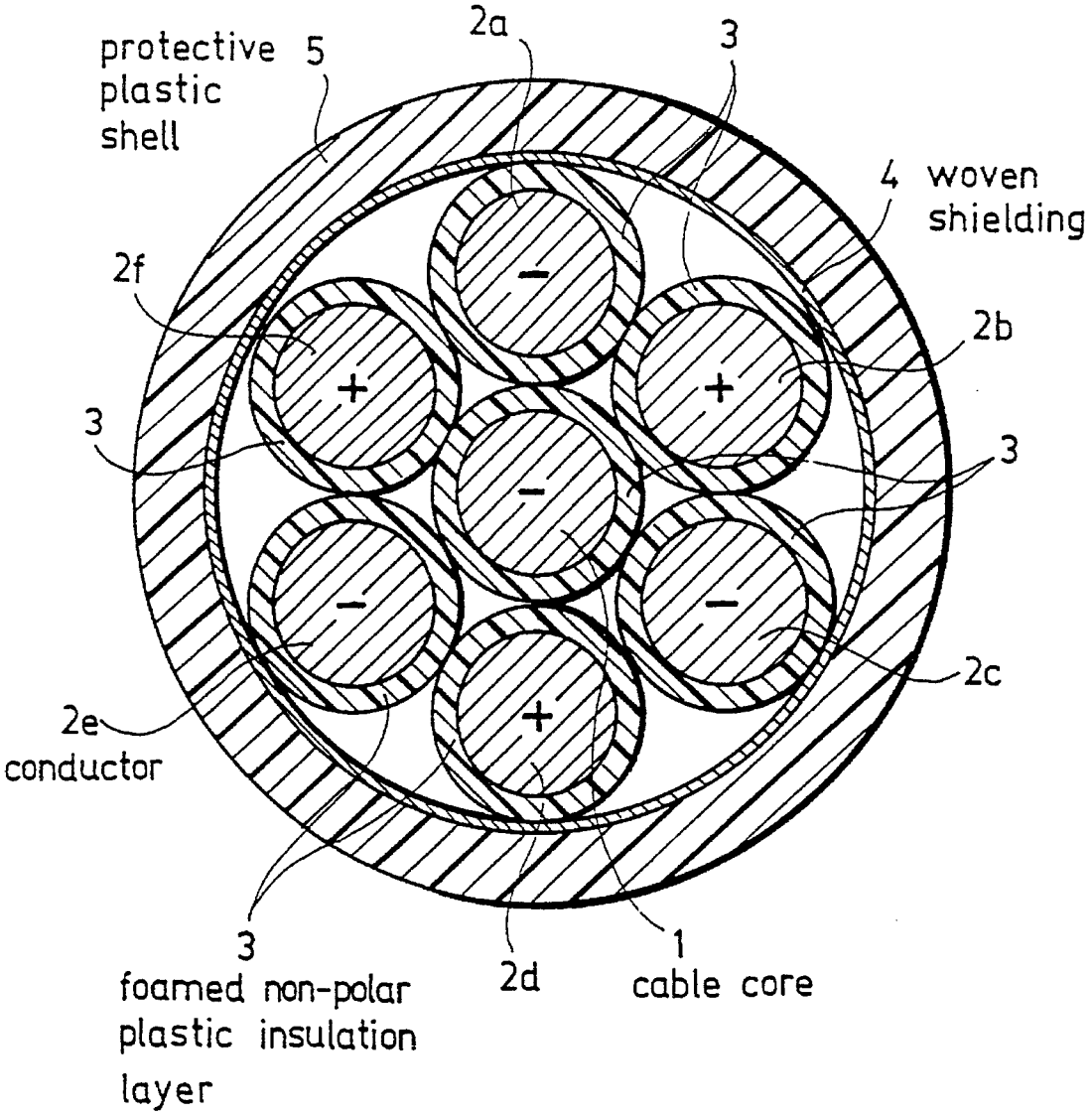
FIG. 1 is a cross-sectional view of an interconnection cable of the present invention.

FIG. 1 shows a cross sectional view of an interconnection cable according to the invention. The cable has a core 1 made of solid, untinned, oxygen-free copper wire with a diameter of 0.8 mm. The core 1 is surrounded by six insulated outer conductors 2 having an outer diameter causing a continuous ring around the core 1 abutting each other. The copper wire forming the core 1 and the conductors 2 are separated from each other by a foamed polyethylene insulation layers 3. Two groups of each three conductors 2 forming first and second signal path of the cable and the core 1 have an insulation layer 3 of different colour for an easy identification. The material of the insulation layers 3 is a first foamed microcell polyethylene layer with an average space factor of 60% and a thickness of 0.4 to 0.6 mm, and a second polyethylene skin layer with a thickness of 0.03 mm, applied in a single production step. The arrangement and the distance of the core 1 and the conductors 2 from each other is determined by the production and this ensures the optimal geometrical and-acoustical parameters without any measurement during or after the production. The semi-fabricated cable is provided with a shielding conductor 4 made of a fabric layer with a density of 75%, woven of copper wire having a diameter of 0.2 mm. The shielding conductor 4 is covered with an outer shell 5 made of solid polyethylene layer with a thickness of 1 mm. The full diameter of the cable described above is cca 7.5 to 8.5 mm.

The insulation layer 3 of the cable can be made of polytetrafluoroethylene with a minimal technological amendment. This results in better electrical (acoustical) parameters and an increased rigidity which should taken into consideration during installation and use of the cable.

Figure 2:
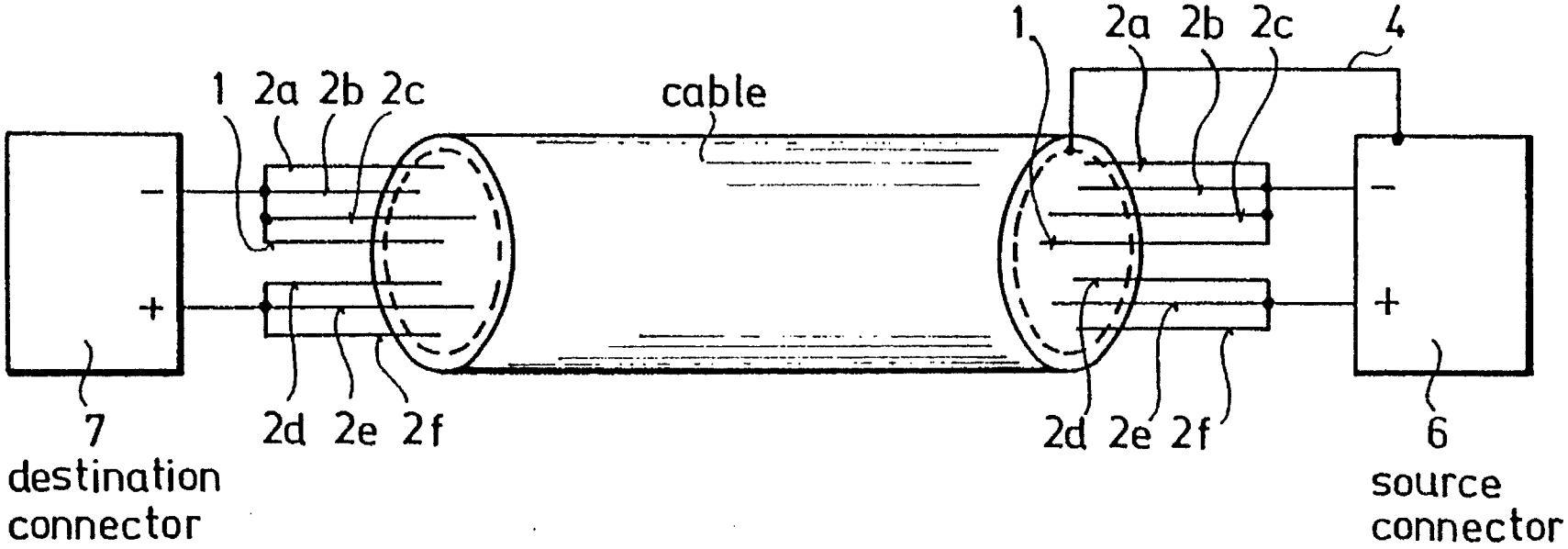
FIG. 2 is a schematic showing of an interconnection cable and its terminations at the source and destination connectors.

FIG. 2 shows the conductors soldered to the first and second pin of a screen cinch plug or coupling connectors.

We claim:

1. An interconnection cable for the transmission of low frequency signals which comprises, a substantially central core for providing mechanical strength to the cable, at least four conductors each covered with a foamed, nonpolar plastic insulation, said conductors forming at least a first and a second signal path having an equal number of insulated conductors in each signal path, a shielding conductor of a fabric layer with a 55% to 95% density woven copper wire each of one or more tenths of a millimeter diameter disposed about said conductors, and an outer shell about said shielding conductor.

2. Interconnection cable according to claim 1, characterized in that the core (1) of the cable is made of a solid, untinned, oxygen-free copper wire with a diameter of 0.8 mm.

3. Interconnection cable according to claim 1, characterized in that the core (1) is surrounded by six insulated conductors (2), three of them forming the first signal path and three of them forming the second signal path of the cable and having a diameter causing a continuous ring around the core (1) abutting each other.

4. Interconnection cable according to claim 1, characterized in that the insulation layer (3) is formed of foamed polyethylene with an average space factor of 40 to 60% and the shielding conductor (4) is made of a fabric layer with a density of 75%, woven of copper wire having a diameter of 0.2 mm.

5. Interconnection cable according to claim 1, characterized in that the conductors (2) forming the first and second signal path of the cable have insulation layers (3) of different color.

6. Interconnection cable according to claim 1, characterized in that the conductors (2) are wrapped around the core (1) in the cable.

7. Interconnection cable according to claim 1, characterized in that the conductors (2) are lined parallel with the core (1) in the cable.

8. Interconnection cable according to claim 1, characterized in that the conductors (2) are soldered to the first, respectively second pin of a screened cinch plug or coupling connector.

* * * * *